US006893789B2

(12) United States Patent
Leskeläet al.

(10) Patent No.: US 6,893,789 B2
(45) Date of Patent: May 17, 2005

(54) METHOD OF PRODUCING PRINTED MATTER

(75) Inventors: Markku Leskelä, Muijala (FI); Esa Torniainen, Lohja (FI); Jyrki Kettunen, Jalaskylä (FI)

(73) Assignee: M-real Oyj, Espoo (FI)

( * ) Notice: Subject to any disclaimer, the term of this patent is extended or adjusted under 35 U.S.C. 154(b) by 68 days.

(21) Appl. No.: 10/182,256

(22) PCT Filed: Jan. 29, 2001

(86) PCT No.: PCT/FI01/00083

§ 371 (c)(1),
(2), (4) Date: Oct. 10, 2002

(87) PCT Pub. No.: WO01/55793

PCT Pub. Date: Aug. 2, 2001

(65) Prior Publication Data

US 2003/0104305 A1 Jun. 5, 2003

(30) Foreign Application Priority Data

Jan. 28, 2000 (FI) ..... 20000185

(51) Int. Cl.[7] ..... G03G 13/16
(52) U.S. Cl. ..... 430/126; 428/211.1; 428/703
(58) Field of Search ..... 430/126; 428/211.1, 428/703; 162/181.8

(56) References Cited

U.S. PATENT DOCUMENTS

| | | | | | |
|---|---|---|---|---|---|
| 3,615,403 | A | | 10/1971 | Cheng | 96/1.5 |
| 4,318,950 | A | * | 3/1982 | Takashi et al. | 428/143 |
| 4,689,282 | A | | 8/1987 | Gidon et al. | 430/39 |
| 4,778,711 | A | | 10/1988 | Hosomura et al. | 428/211 |
| 6,280,831 | B1 | * | 8/2001 | Nakanishi et al. | 428/211.1 |
| 6,393,985 | B1 | * | 5/2002 | Tashiro et al. | 101/462 |
| 6,468,393 | B1 | * | 10/2002 | Small et al. | 162/134 |

FOREIGN PATENT DOCUMENTS

| | | |
|---|---|---|
| CA | 1 140 332 A | 2/1983 |
| EP | 0 718 700 A2 | 6/1996 |
| FR | 2 588 583 A1 | 4/1987 |
| GB | 1 353 372 A | 5/1974 |
| WO | 90/13064 A1 | 11/1990 |

* cited by examiner

*Primary Examiner*—John L Goodrow
(74) *Attorney, Agent, or Firm*—Kubovcik & Kubovcik

(57) ABSTRACT

A method for producing printed products, according to which method the surface of a sheet of paper or board is printed by the electrophotography technique or a similar printing method, wherein a dry finely-divided printing ink is transferred onto the printing base by means of an electric field. According to the invention, a paper or board is used the printing surface of which has a pigment-containing coating layer in which at least 20% of the pigment is made up of a hydrous pigment, such as gypsum, or in which at least 20% of the filler is made up of a hydrous filler, such as gypsum. When a gypsum pigment and/or a gypsum filler is used, the quality of the printed image is not sensitive to the control quantities used in the printing press. By means of the invention, a very regular print is indeed obtained, and so the invention is especially well suited for the printing of a sheet of a very matt paper or board.

10 Claims, 1 Drawing Sheet

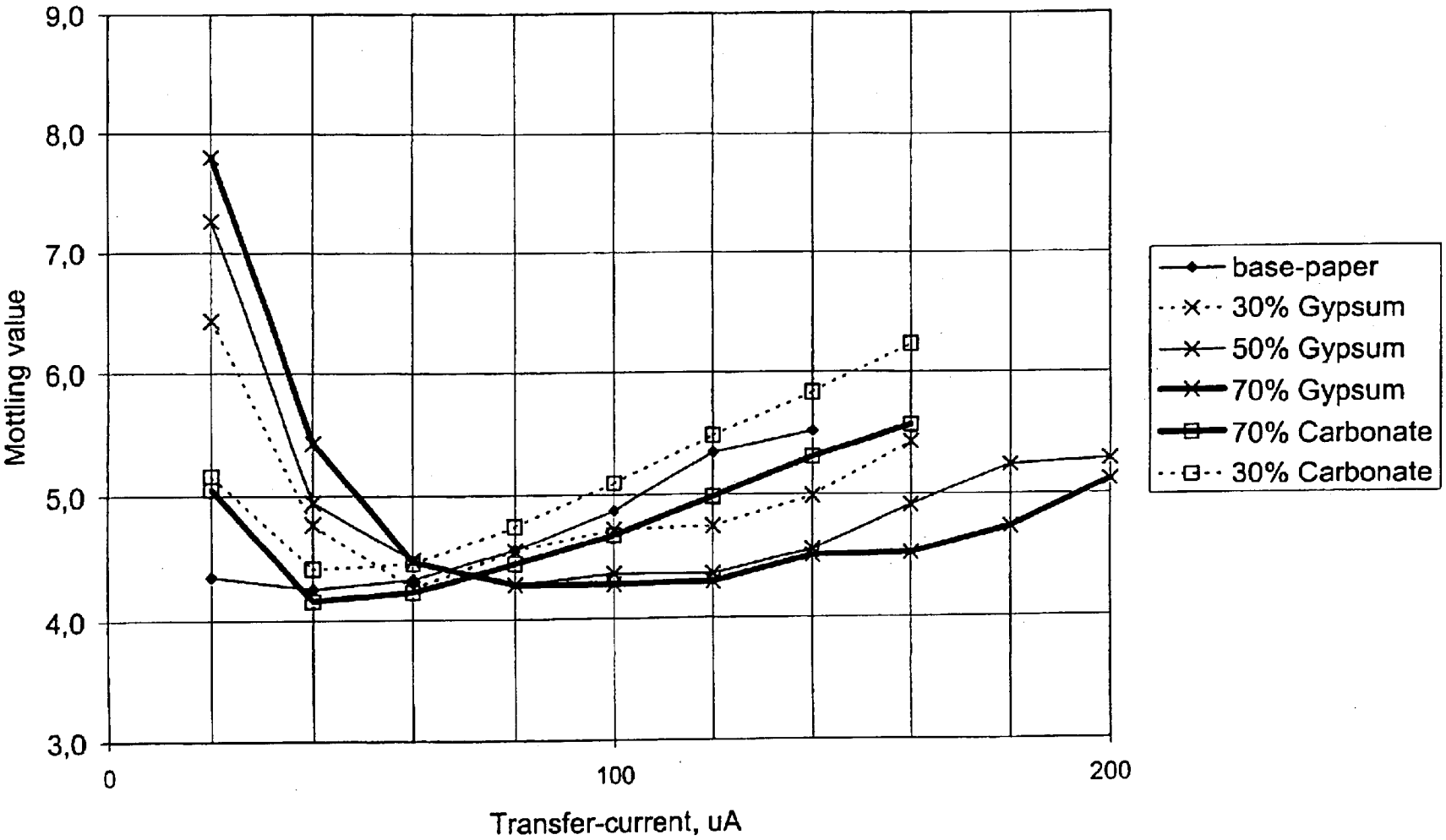
base-paper
30% Gypsum
50% Gypsum
70% Gypsum
70% Carbonate
30% Carbonate
Mottling value
9,0
8,0
7,0
6,0
5,0
4,0
3,0
0
100
200
Transfer-current, uA

METHOD OF PRODUCING PRINTED MATTER

The present invention relates to a method according to the preamble of claim 1 for producing printed matter.

According to such a method, the desired image is printed on a paper or board product by the electrophotography technique or a corresponding printing method wherein a dry, finely-divided coloring agent is transferred onto the printing substrate by means of an electric field.

Most printed matter is printed by offset or rotogravure techniques. Especially in the printing of packaging materials, flexography is also used to a great extent. These techniques have a significant limitation in that they have been developed for production wherein a large number of mutually identical copies are substantially duplicated.

Developing digital techniques have, however, created on the one hand new possibilities and on the other hand new needs for the production of printed matter. One example is so-called print-on-demand printing, in which, for example, books are printed according to the consumer requirement either in small editions (typically fewer than 500 copies) or even in individual copies. Another example is the production of printed advertising material, in which either the print-on-demand principle is applied merely to making short printing runs or additionally the content of printed matter can be versioned and tailored down to single-copy printing runs.

The electrophotography technique is at present the market leader in the production of printed matter of the above type. In this technique, the image to be printed is formed on the photoconductor drum separately for each revolution of the drum, and consequently the contents of successive pages may be completely different. Thus, for example, a book can be printed to completion so that the pages arrive on the delivery table of the printing machine in the correct order of pages. Electrophotographic printing machines and printers are available for both black-and-white printing and four-color printing.

Electrophotography has long been used as a technique in office copiers and laser printers. In office use the papers used have been uncoated fine papers, with which there has indeed been obtained a sufficiently high image quality for black-and-white text-containing material. In printed advertising material there are, however, a large number of four-color images, and therefore the quality of color images has become an important issue. For success in high-quality four-color printing it is in general desirable to use coated papers, since on them the visual quality and sharpness of color images can be raised to a level higher than that on uncoated papers.

In the printing of four-color images, the most significant quality problem in electrophotography lies in mottled print. The spots are 0.1–20 mm in size, and spots of a few millimeters are visually the most disturbing. The problem is usually at its worst with coated papers having a grammage of over 200 gsm.

Van Daele et al. in their article [Van Daele, J., Verluyten, L., and Soulliaert, E., Print Media for Xeikon's DCP/32D Digital Color Press, IS&T's NIP12: International Conference on Digital Printing Technologies pp. 382–386] discuss the operation and paper issues of a Xeikon four-color electrophotography printing press. Toner particles are transferred from a photoconductor drum to the paper by means of an electric field, negatively charged toner particles transferring onto positively charged paper. The charge is created on the paper surface by means of a corona located so that the paper is between the corona wire and the photoconductor drum. As is pointed out in the article, conductivity is an important property of the paper in terms of the success of this process. If the paper is too conductive, the charge discharges from the paper and the toner particles may return to the surface of the photoconductor drum. If, on the other hand, the paper is too insulating, a sufficiently strong electric charge may not have time to develop on the paper surface.

Immediately after the toner transfer zone there is another corona, which discharges the surface charge of the paper so that no electric spark-over will occur in the opening nip between the paper and the photoconductor drum.

In addition, it is generally assumed that the electric properties of paper are uneven, and therefore, even though the conductivity and resistivity are on average at the correct levels, there may be local problem areas in the paper. This train of thought is highly understandable even because paper always to some extent has a non-uniform distribution of material (formation is not perfect). The above-mentioned problem of mottling is explained precisely in this way. The problem is at its worst in coated papers having a grammage of over 200 gsm.

It is further stated in the article by Van Daele et al. that the conductivity of paper is strongly dependent on the moisture content of the paper. For this reason, the Xeikon press indeed has a pre-treatment unit wherein the charging capacity of the paper is adjusted to the correct level by heating. As a summary of the paper properties van Daele et al. note: In general, low conductivity of paper in the z-orientation (bulk conductivity) is desirable for good toner transfer, whereas high surface conductivity is advantageous because in this case any static charges will discharge rapidly and, on the other hand, any charge distribution possibly produced by the corona is leveled out, improving the uniformity of toner transfer.

In many situations a skilful and careful operator may rectify problems caused by paper properties; an operator namely has available a number of control methods by which he may reduce the problems of mottling. Such settings in the Xeikon press include the temperature of the pre-treatment unit and the corona wire control currents in the press itself. However, the finding of the correct settings takes a great deal of time, which reduces the printing press time usable for printing. The finding of the correct settings also causes extra materials costs as toners and papers are wasted. On the other hand, there are on the market also electrophotography machines in which it is not possible significantly to adjust the parameters of copying.

The object of the present invention is to eliminate the problems of the present-day options and to provide an entirely novel method for producing printed matter by the electrophotography technique. The invention is based on the surprising observation that by using, in printing methods wherein a dry finely-divided printing ink is transferred to the printing base by means of an electric field, a paper which contains a hydrous pigment or filler the problem of non-uniformity of the print is reduced substantially. The invention is preferably applied to coated papers having a gypsum pigment in their coating, but corresponding results are also achieved by using gypsum as a filler. We have observed that hydrous pigments and fillers, of which gypsum is used below as a preferred example, clearly deviate, for example in electrophotography applications, from other pigments (such as anhydrous kaolin and calcium carbonate). Furthermore, it has been observed, surprisingly, that the dependence of the charging of such paper on the moisture content of the paper is significantly reduced.

In the method according to the invention for producing printed matter by the electrophotography technique, there is thus used paper or board coated with a pigment-containing coat in which at least 20% of the mineral pigment is made up of gypsum, or in which at least 20% of the filler is made up of gypsum.

More specifically, the method according to the invention is mainly characterized by what is stated in the characterizing part of claim 1.

The invention provides considerable advantages. Thus, when a gypsum pigment is used and/or gypsum is used as a filler, the quality of the printed image is not sensitive to the control quantities used in the press. These advantages are described in greater detail in the example presented below. It should be noted that the advantageous properties of gypsum, in particular as regards the uniformity of the printing surface and the minimization of mottling, are best manifested in twice-coated papers having a grammage above 150 g/m$^2$. By means of the invention, a very uniform print is obtained, the invention being especially suited for the printing of a sheet of matt paper or board, since in these, printed images are distinguished from the background especially clearly and even slight irregularity of the print is visible.

According to one preferred embodiment, the invention relates to the printing of four-color images electrophotographically by using paper or board coated with gypsum pigments.

The invention will be examined below in greater detail with the help of a detailed description, with reference to the accompanying drawing. The figure shows the irregularity of the printed surface (mottling number) as a function of the transfer current for six different papers.

According to the invention, the electrophotography paper used is a gypsum-coated web of material. By 'web of material' is meant in this invention paper or board or a corresponding cellulosic material derived from a lignocellulose-containing raw material, in particular from wood or from annual or perennial plants. The said material may be wood-containing or woodfree, and it may be produced from mechanical, semi-mechanical (chemimechanical) or chemical pulp. The pulp may be bleached or unbleached. The material may also contain recycled fibers, in particular recycled paper or recycled board. The web of material may be made up of 100% chemical pulp, but it may also be produced from a mixture of mechanical pulp and chemical pulp, in which the proportion of mechanical pulp may be 80–30%. Such a mixture may contain pulp made from hardwood or softwood by mechanical defibration methods, such as GW, PGW, TMP or CTMP. The raw material used may be spruce. An especially advantageous product is arrived at by coating a base paper produced from a mixture of a chemical pulp and a mechanical pulp of aspen or some other wood species of the *Populus* family. The chemical pulp may be made by any suitable method from hardwood or softwood, preferably softwood. The grammage of the web of material ranges typically within 30–250 $\mu$m$^2$.

The filler used in the web may, in a known manner, be calcium carbonate. It is, however, also possible to replace at least a portion (at least 20%) of the carbonate with gypsum or a corresponding hydrous filler. At least a portion of the hydrous pigments in the coating may be replaced with a hydrous filler.

According to a preferred embodiment of the invention, a suitable electrophotography paper is, however, obtained by coating a web of material with a gypsum-containing coating mix or with a coating mix which contains some other suitable hydrous pigment. The use of pigment according to the invention is described below in greater detail by using gypsum as an example:

A gypsum-containing coating mix can be used as a single-coat mix and as a so-called pre-coat and a surface-coat mix. It is preferable to coat the material twice, first with a pre-coat mix and then with a surface-coat mix. The gypsum pigment used is preferably a product having an abrupt particle size distribution, since said distribution provides a good cover.

In general the coating mix according to the invention contains at least one pigment or a mixture of pigments 10–100 parts by weight, at least one binder 0.1–30 parts by weight, and other additives, known per se, 1–10 parts by weight. Most suitably the paper or board is coated with a coating composition containing

| | |
|---|---|
| precipitated calcium carbonate | 10–50 parts and/or |
| kaolin | 10–50 parts and |
| gypsum | 30–90 parts |
| pigment in total | 100 parts |
| and | |
| binder | 1–20% of the pigment |
| thickener | 0.1–10% of the pigment |

A typical composition of the pre-coat mix is, for example, as follows:

| | |
|---|---|
| coating pigment (gypsum and/or, for example, coarse calcium carbonate) | 100 parts by weight |
| binder | 1–20% of the weight of the pigment |
| additives and auxiliary agents | 0.1–10% of the weight of the pigment |
| water | balance |

The dry solids content of the pre-coat mix is typically 40–70% and its pH 7.5–9.

The composition of the surface-coat mix or single-coat mix according to the invention is, for example, as follows:

| | |
|---|---|
| coating pigment I (gypsum) | 30–90 parts by weight |
| coating pigment II (e.g. fine kaolin and/or calcium carbonate) | 10–70 parts by weight |
| pigment in total | 100 parts by weight |
| binder | 1–20% of the weight of the pigment |
| additives and auxiliary agents | 0.1–10% of the weight of the pigment |
| water | balance |

The dry solids content of this coating mixture is typically 50–75%.

According to the invention, in the coating mixtures presented above there is preferably used a gypsum pigment having an steep particle size distribution, in which case at maximum 35% of the pigment particles are smaller than 0.5 $\mu$m, preferably at maximum 15% are smaller than 0.2 $\mu$m. The abrupt-distribution particle size distribution curve is below the corresponding curve for conventional pigment in the range of small pigment fractions. Respectively, the pigment curve is above the conventional pigment in the range of medium-sized particles.

Together with or instead of gypsum it is possible to use in the pre-coat or respectively the surface-coat mix any known pigment. Examples that can be cited of pigments include calcium carbonate, aluminum silicate, kaolin (hydrous aluminum silicate), aluminum hydroxide, magnesium silicate, talc (hydrous magnesium silicate), titanium dioxide and barium sulfate, as well as mixtures thereof. Synthetic pigments can also be used. Instead of gypsum, any of the above-mentioned hydrous pigments can be used as the hydrous pigment.

Of the pigments mentioned above, the main pigments in addition to gypsum or a corresponding hydrous pigment are kaolin and calcium carbonate, which in general constitute over 50% of the dry solids of the coating mixture. Calcined kaolin, titanium dioxide, precipitated carbonate, satin white, aluminum hydroxide, sodium silico-aluminate and plastics pigments are additional pigments, and their amounts are in general less than 25% of the dry solids of the mixture. Special pigments that can further be cited include special-quality kaolins and calcium carbonates, as well as barium sulfate and zinc oxide.

Especially preferably the main pigment in pre-coat mixes is calcium carbonate and/or gypsum, and in surface-coat mixes and single-coat mixes, mixtures of gypsum and/or calcium carbonate or kaolin. There is gypsum in at least one of the coating mixes introduced onto the paper surface.

It is possible to use as binders in the coating composition any known binders generally used in paper production. Besides individual binders, it is also possible to use mixtures of binders. Examples of typical binders include synthetic latexes made up of polymers or copolymers of ethylenically unsaturated compounds, e.g. copolymers of the butadiene-styrene type, which possibly also have a comonomer containing a carboxyl group, such as acrylic acid, itaconic acid or maleic acid, and polyvinyl acetate having comonomers that contain carboxyl groups. Together with the materials cited above, it is possible further to use as binders, for example, water-soluble polymers, starch, CMC, hydroxyethyl cellulose and polyvinyl alcohol.

Furthermore, it is possible to use in the coating composition conventional additives and auxiliary agents, such as dispersants (e.g. sodium salt of polyacrylic acid), agents affecting the viscosity and water retention of the mixture (e.g. CMC, hydroxyethyl cellulose, polyacrylates, alginates, benzoate), so-called lubricants, hardeners used for improving water-resistance, optical auxiliary agents, anti-foaming agents, pH control agents, and preservatives. Examples of lubricants include sulfonated oils, esters, amines, calcium or ammonium stearates; of agents improving water resistance, glyoxal; of optical auxiliary agents, diaminostilbene disulfonic acid derivatives; of anti-foaming agents, phosphate esters, silicones, alcohols, ethers, vegetable oils; of pH control agents, sodium hydroxide, ammonia; and finally of preservatives, formaldehyde, phenol, quaternary ammonium salts.

A salt, e.g. NaCl, can be added to papers in order to control its electric properties.

The coating mix can be applied to the material web in a manner known per se. According to the invention, paper and/or board can be coated online or offline by using a conventional coating device, i.e., by blade coating, or by film coating or JET application.

Preferably the material web is coated twice, the first coating being carried out by the film transfer method and the second coating by blade coating. In general, an amount of 5–50 g of coating mix/m$^2$ is applied to the web by the film transfer method and 10–60 g of coating mix/m$^2$ by blade coating, the coating amounts having been calculated on the basis of the dry solids of the coating composition.

After the coating the paper is preferably calendered. The calendering can be carried out in the paper machine (online) or after the paper machine (offline). If it is desirable to render the paper surface glossy (gloss above approx. 40–50%), the calendering is preferably carried out by means of a supercalender. If the targeted paper gloss is below 40–50%, the papers are called matt or satin papers. According to whether glossy paper or matt paper is concerned, the surface material of the calender rolls and the calender process conditions, above all the roll temperatures and the linear pressure, but possibly also the calender speed and the steaming, are set at different levels. While with glossy paper the aim in principle is to achieve as high a gloss as possible, matt paper is above all desired to be very smooth, but so that the structure of the surface will not reflect light in the manner of glossy paper.

Preferably the web of material is fine paper, possibly pre-coated. Thus, according to a preferred embodiment of the invention, in four-color printing by electrophotography, a paper or board which has been coated twice is used, in which case at least one-half of the pigments in at least one of the coats is gypsum. Preferably gypsum pigment has been used at least in the second coat, which is on top of the first pigment-containing coat. As is evident from the example below, especially good results are achieved by using at least 60% gypsum as the paper coating pigment.

In practice, the grammage of the sheets of paper or board used in the invention may vary widely, preferably it is approx. 60–450 g/m$^2$. The paper or board has 5–30 g of coating/m$^2$/side, and the paper or board is calendered. The calendering can be carried out, for example, by matt calendering, silk calendering or supercalendering.

The desired image is printed by electrophotography on the paper according to the invention. By 'image' is meant any impression printed on the paper surface. The term covers text and simple graphic representations printed by black-and-white printing or by color printing, as well as pictures, including photographs, produced by four-color printing.

The conditions presented in the literature can be complied with in electrophotography (cf. the article by Van Daele et al., mentioned above).

EXAMPLE

Preparation of Samples

Trial coating was carried out at the Central Laboratory by using five different mixes. The base paper was a 124 g/m$^2$ pre-coated base paper for fine paper (Äänekoski art-paper mill). The speed of the coating machine was 800 m/min. The coating was run by the so-called roll application method, and the mix was evened out with a blade.

The variables in the mixes were the pigments and their dosing proportions. All of the pastes contained as binders and additives the following:

latex DOW DL 966, 12 parts thickener CMC Finnfix 30, 1 part

Glyoxal T, 0.3 parts

Nopcote C104, 1 part optical brightener Blankophor P, 1 part

The target pH in the gypsum-containing mixes was pH 7.5, in the other mixes pH 8.5. The target solids contents of the pastes ranged from 62 to 63%.

The papers were coated twice on both sides so that the final grammage was 166–168 g/m$^2$.

The coated test papers were calendered in constant conditions; this was done to ensure that the moisture differences among the test papers would be as small as possible. The gloss of the coated papers ranged from 67 to 82% (Hunter 75°). The uncoated (pre-coated) base paper having a very low gloss, approx. 10%, was also calendered in the same conditions. The accompanying table presents the test papers, their pigment compositions, and the moisture contents (Rh) measured from the completed calendered reels.

TABLE 1

| Test papers: | 4 | 8 | 12 | 16 | 20 | 0 |
|---|---|---|---|---|---|---|
| Kaolin | 70 | 50 | 30 | 30 | 70 | — |
| Gypsum | 30 | 50 | 70 | 0 | 0 | — |
| Carbonate HCCC | 0 | 0 | 0 | 70 | 30 | — |
| Moisture | 43% | 42.50% | 41% | 40% | 44% | 26% |

Trial Printing

The trial printing was carried out using an IBM Info-Color70 press (Xeikon DCP32/D). The test papers presented in the table were printed so that the conductivity/resistivity of each paper grade was adjusted to the same level in the pre-treatment unit. The conditions of the gloss and fixing units were also maintained constant. The setting value U2 indicating resistivity was set at 320 volts; thus each paper was dried so that its resistivity rose to a sufficiently high level. There was no difficulty in achieving the level of 320 V with any of the papers, and the currents required for this and the temperature of the drying cylinder did not rise above the guideline values. The essential variables are shown in the accompanying table:

TABLE 2

| | 4 | 8 | 12 | 16 | 20 | 0 |
|---|---|---|---|---|---|---|
| Corona current required for reaching the U1 value (max 200 μA) | 19 | 18 | 16 | 25 | 25 | 23 |
| Heating roll temperature | 160 | 156 | 162 | 144 | 158 | 82 |
| Heating roll power (percent of the maximum) | 63 | 60 | 60 | 56 | 70 | 30 |

It is possible to print a good image quality on each of the paper grades. In this comparison, however, the purpose was to study the sensitivity of the paper to outside influences. This was implemented by printing with different settings on each paper grade. This varying corresponds to at least some extent to the internal fluctuation within a printing press (aging of the developer, climate, age of the photoconductor drums, etc.).

The varied setting values were the transfer current and the duplex current. Transfer current denotes the corona current by means of which the charging of the paper surface is controlled through the transfer corona (cf. the preamble). Duplex current denotes the corona current by means of which the charge of the paper and of the toner is evened out through the duplex corona before the subsequent toner transfer unit.

The table shows the test matrix and the area of the even printed surface determined on the basis of a visual comparison. A visually acceptable surface is commented on in the table by using the word "good."

TABLE 3

| Transfer | Duplex | 0 | 4 | 8 | 12 | 16 | 20 |
|---|---|---|---|---|---|---|---|
| 20 | | Good | | | | | |
| 40 | | Good | | | | Good | Good |
| 60 | | Good | Good | Good | Good | Good | Good |
| 80 | | Good | Good | Good | Good | Good | Good |
| 100 | | | Good | Good | Good | | |

TABLE 3-continued

| Transfer | Duplex | 0 | 4 | 8 | 12 | 16 | 20 |
|---|---|---|---|---|---|---|---|
| 120 | | | | Good | Good | | |
| 140 | | | | | Good | | |
| 160 | | | | | Good | | |
| 180 | | | | | Good | | |
| 200 | | | | | | | |
| | 40 | | | | Good | | |
| | 60 | | Good | Good | Good | | |
| | 80 | Good | Good | Good | Good | | |
| | 100 | Good | Good | Good | Good | Good | Good |
| | 120 | Good | | | | Good | Good |
| | 140 | Good | | | | Good | Good |
| | 160 | Good | | | | | |
| | 180 | Good | | | | | |
| | 200 | Good | | | | | |

In the transfer series the duplex current was maintained constant. The level was sought by adjusting the settings so as to be as good as possible. According to the series, the levels were:

Test papers 0 and 4: 80 μA

Test papers 8, 12, 16 and 20: 100 μA

In the duplex series, the transfer values were maintained constant. The value was selected on the basis of the transfer series. According to the series, the levels were:

Test papers 0, 16 and 20: 80 μA

Test papers 4, 8 and 12: 60 μA

This table must be taken with reservation. It does not take a stand regarding the differences among the test papers but indicates only the size of the operating window within which the most uniform quality possible is obtained for the paper.

On the basis of a visual inspection, however, the following observations can be made:

Gypsum deviates from the other pigments, and its difference from the uncoated paper is greatest.

Gypsum would seem to require higher transfer values and lower duplex values than kaolin and carbonate.

The good properties of gypsum are most manifest when the amount of gypsum is 70 parts.

Kaolin and carbonate behave in a similar manner; the operating window is exactly the same with respect to both duplex and transfer.

The visual image quality was ascertained by objective measuring, wherein the mottling of a completely covered surface was measured image analytically by means of a mottling viewer apparatus (Only Solutions). This apparatus measures the mottling of the surface in different frequency bands and calculates from them a single mottling value. In the accompanying figures the results are presented so that the mottling measured from the surface is on the y-axis and the transfer current is on the x-axis. The lower the mottling value, the less mottled the surface, and the flatter the curve, the less the paper is dependent on the external conditions (moisture variation, age of the developer, the condition of the drums, etc.).

FIG. 1 shows that two papers are clearly distinguishable from the others: the samples containing 50 and 70 parts of gypsum would not seem to be sensitive to changes in the transfer current but repeat color surfaces evenly over a large area. The sample containing 30 parts of gypsum works somewhat better than the samples without gypsum but is distinguishable as clearly poorer than the other two gypsum samples.

What is claimed is:

1. A method for producing printed matter, according to which method a desired image is printed on the surface of a sheet of paper or board by the electrophotography technique or a similar printing method, wherein a dry finely-divided printing ink is transferred onto the printing base by means of an electric field, characterized by using a paper or board made from a pulp derived from a lignocellulose-containing raw material which has on its printing surface a pigment-containing coating layer in which at least 20% of the pigment is made up of gypsum, or in which at least 20% of any filler is made up of gypsum.

2. A method for producing printed matter, according to which method a desired image is printed on the surface of a sheet of paper or board by the electrophotography technique or a similar printing method, wherein a dry finely-divided printing ink is transferred onto the printing base by means of an electric field, characterized in that a sheet of paper or board made from a pulp derived from a lignocellulose-containing raw material is used which has been coated twice, at least 50% of the pigments in at least one pigment-containing coating layer being made up of gypsum.

3. A method for producing printed matter, according to which method a desired image is printed on the surface of a sheet of paper or board by the electrophotography technique or a similar printing method, wherein a dry finely-divided printing ink is transferred onto the printing base by means of an electric field, characterized in that a sheet of paper or board made from a pulp derived from a lignocellulose-containing raw material is used which has been coated twice, at least 50% of the pigment of the second, pigment-containing coating layer on top of the first pigment-containing coating layer being made up of gypsum.

4. The method according to claim 1, characterized in that paper sheets are used the grammage of which is approx. 100–250 g/m$^2$.

5. The method according to claim 1, characterized in that a paper or board is used in which at least 60% of the pigment in the coating layer is made up of gypsum.

6. The method according to claim 1, characterized in that the paper or board is coated with a coating composition which contains gypsum as a pigment together with precipitated calcium carbonate, kaolin, chalk and/or talc.

7. The method according to claim 1, characterized in that the paper or board is coated with a coating composition which contains

| | |
|---|---|
| precipitated calcium carbonate | 10–50 parts by weight and/or |
| kaolin | 10–50 parts by weight and |
| gypsum | 30–90 parts by weight |
| pigment in total | 100 parts by weight |
| binder | 1–20% of the weight of the pigment |
| thickener | 0.1–10% of the weight of the pigment. |

8. The method according to claim 1, characterized in that the paper or board has 5–50 g of coating/m$^2$/side.

9. The method according to claim 1, characterized in that the paper or board is calendered.

10. The method according to claim 1, characterized in that a four-color image is printed on the surface of the sheet of paper or board by the electrophotography technique.

* * * * *